US005133044A

United States Patent [19]

Chiu

[11] Patent Number: 5,133,044

[45] Date of Patent: Jul. 21, 1992

[54] PORTABLE HUMIDIFIER

[75] Inventor: Bernard Chiu, Ashland, Mass.

[73] Assignee: Duracraft Corporation, Sudbury, Mass.

[21] Appl. No.: 792,840

[22] Filed: Nov. 15, 1991

Related U.S. Application Data

[62] Division of Ser. No. 560,957, Aug. 1, 1990, Pat. No. 5,067,169.

[51] Int. Cl.[5] ..... F24F 3/14; H05B 3/78

[52] U.S. Cl. ..... 392/405; 392/403; 392/406; 200/81.9 R

[58] Field of Search ..... 392/401-407, 392/394; 200/84 C, 81.9 R, 81.9 M; 219/271, 272, 273, 275

[56] References Cited

U.S. PATENT DOCUMENTS

| | | | |
|---|---|---|---|
| 2,810,167 | 10/1957 | Parks | 392/405 |
| 3,723,707 | 3/1973 | Wunderlin | 392/406 |
| 3,892,945 | 7/1975 | Lerner | 392/405 |
| 4,564,746 | 1/1986 | Morton et al. | 219/276 |
| 4,752,423 | 6/1988 | Wong | 392/406 |
| 4,810,854 | 3/1989 | Jursich et al. | 392/406 |
| 5,014,338 | 5/1991 | Glucksman | 392/405 |
| 5,067,169 | 11/1991 | Chiu | 392/406 |

*Primary Examiner*—Bruce A. Reynolds
*Assistant Examiner*—Tuan Vinh To
*Attorney, Agent, or Firm*—John E. Toupal; Harold G. Jarcho

[57] ABSTRACT

A humidifier including a base defining a boiler cavity; a liquid supply supported on the base and having a discharge opening communicating with the boiler cavity and adapted to maintain a given level of liquid therein; and an evaporation unit removably mounted on the base and adapted to induce evaporation of liquid contained thereby, and a vapor passage having a receiving end communicating with said cavity so as to receive vapor therefrom and a discharge end for discharging the vapor received from cavity. Also icluded is an electrical supply for supplying electrical energy to the heater; a switch mounted on the evaporation unit and adapted in one condition for deactivating the electrical supply and in another condition for activating the electrical supply and an actuator for producing the one condition in response to separating movement between the base and evaporation unit.

9 Claims, 3 Drawing Sheets

PORTABLE HUMIDIFIER

CROSS-REFERENCE TO RELATED APPLICATION

This invention is a division of U.S. application Ser. No. 07/560,957 filed Aug. 1, 1990, entitled PORTABLE HUMIDIFIER, now U.S. Pat. No. 5,067,169.

BACKGROUND OF THE INVENTION

This invention relates generally to humidifiers and, more specifically, to portable humidifiers intended for domestic use.

Various types of products are used to increase the humidity in the home environment. With respect to portable humidifying appliances, they may be broken down broadly into two categories, one being the evaporation type and the other being the steam vaporizer type. Evaporation type humidifiers typically utilize belts, pumps, slingers or the like to increase the rate of evaporation of the water from the liquid to the vapor state. Steam vaporizers generally are used to achieve very high humidification levels. Also known are humidifiers which use ultrasonic means to atomize water and thereby increase humidity.

Examples of various prior art steam vaporizers are disclosed in U.S. Pat. Nos. 2,369,623; 2,804,870; 2,810,167; 3,152,240; 3,723,707; 4,604,246; 4,810,854 and U.S. patent application Ser. Nos. 487,315 and 509,885. All of these patents and applications are characterized by disclosing steam type humidification means in which there is a reservoir or water supply of some type which supplies water in controlled amounts to a boiler or heating means which is intended to convert the water into a steam vapor.

There are many problems involved with the prior art steam vaporizers. For example, the mineral deposits left by boiled water is difficult to clean and often causes deterioration of heater elements. Also, unsafe operation can exist under certain conditions.

The object of this invention, therefore, is to provide an improved portable humidifier for use in domestic applications.

SUMMARY OF THE INVENTION

The invention is a humidifier including a base defining a boiler cavity; a liquid supply means supported on the base and having a discharge opening communicating with the boiler cavity and adapted to maintain a given level of liquid therein; and an evaporation unit removably mounted on the base and comprising an electrically energized heater projecting into the cavity and adapted to induce evaporation of liquid contained thereby, and a vapor passage having a receiving end communicating with the cavity so as to receive vapor therefrom and a discharge end for discharging the vapor received from the cavity. Also included is an electrical supply for supplying electrical energy to the heater; a switch adapted in one condition for deactivating the electrical supply and in another condition for activating the electrical supply and an actuator for producing the one condition in response to separating movement between the base and evaporation unit.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
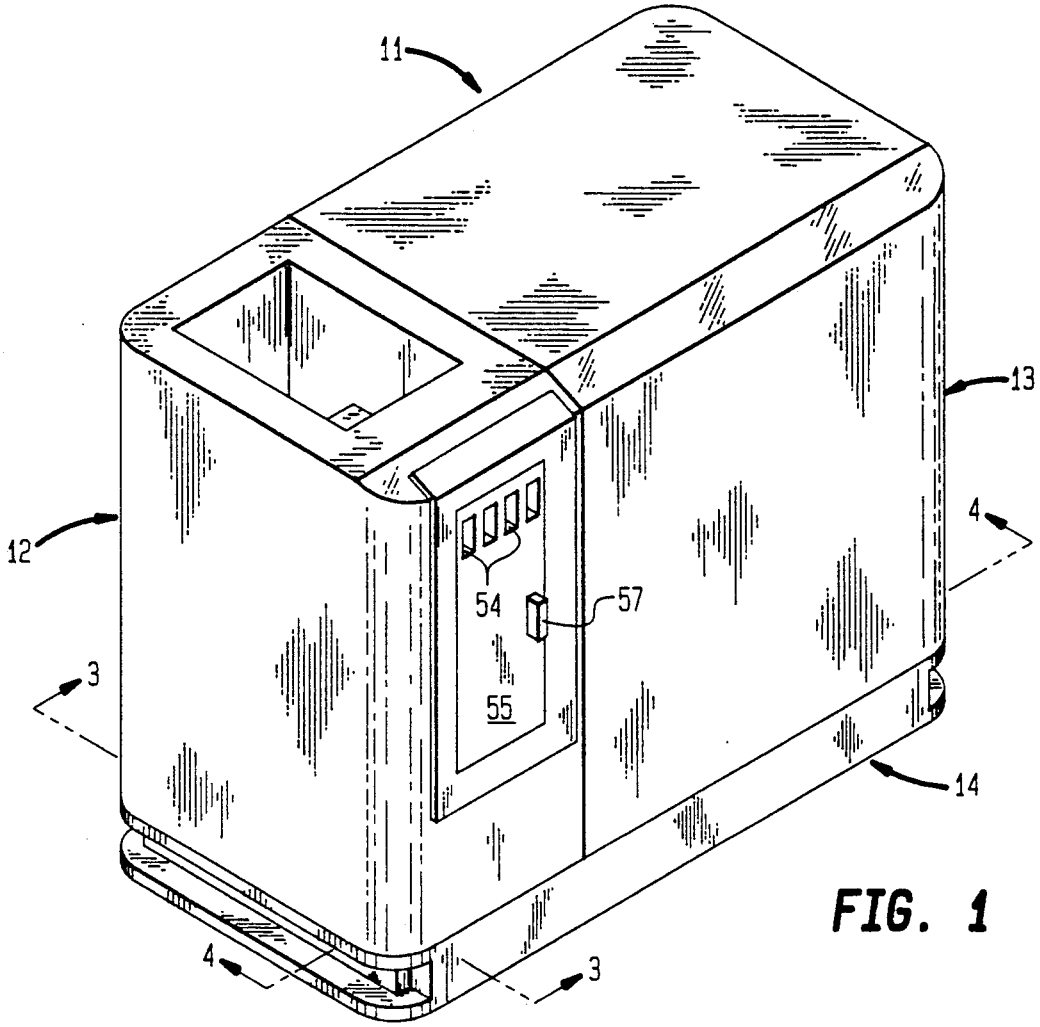
FIG. 1 is a perspective view of a humidifier in accordance with the invention.

A humidifier 11 includes an humidification unit 12 and a liquid supply tank 13 each removably mounted side by side on a base 14. A peripheral rim portion 15 and a divider wall 16 project upwardly from an upper surface 17 of the base 14 and define an evaporator enclosure 18 for removably receiving the evaporation unit 12. Similarly a peripheral portion 19 projecting upwardly from the upper surface 17 and the divider wall 16 define a tank enclosure 21 for removably receiving the supply tank 13.

Formed in the base 14 and below the base surface 17 is a reservoir 20 that includes a boiler cavity 22 disposed within the enclosure 18. Also included in the reservoir 20 is a liquid supply channel 23 having an outlet end 24 communicating with the boiler cavity 22 and an inlet end 25 located within the tank enclosure 21. A valve actuator stem 26 projects upwardly from a bottom 27 of the liquid supply channel 23 into the inlet end 25. Pivotally mounted on the base surface 17 is a latch member 28 for securing the unit 12 to the base 14.

Figure 2:
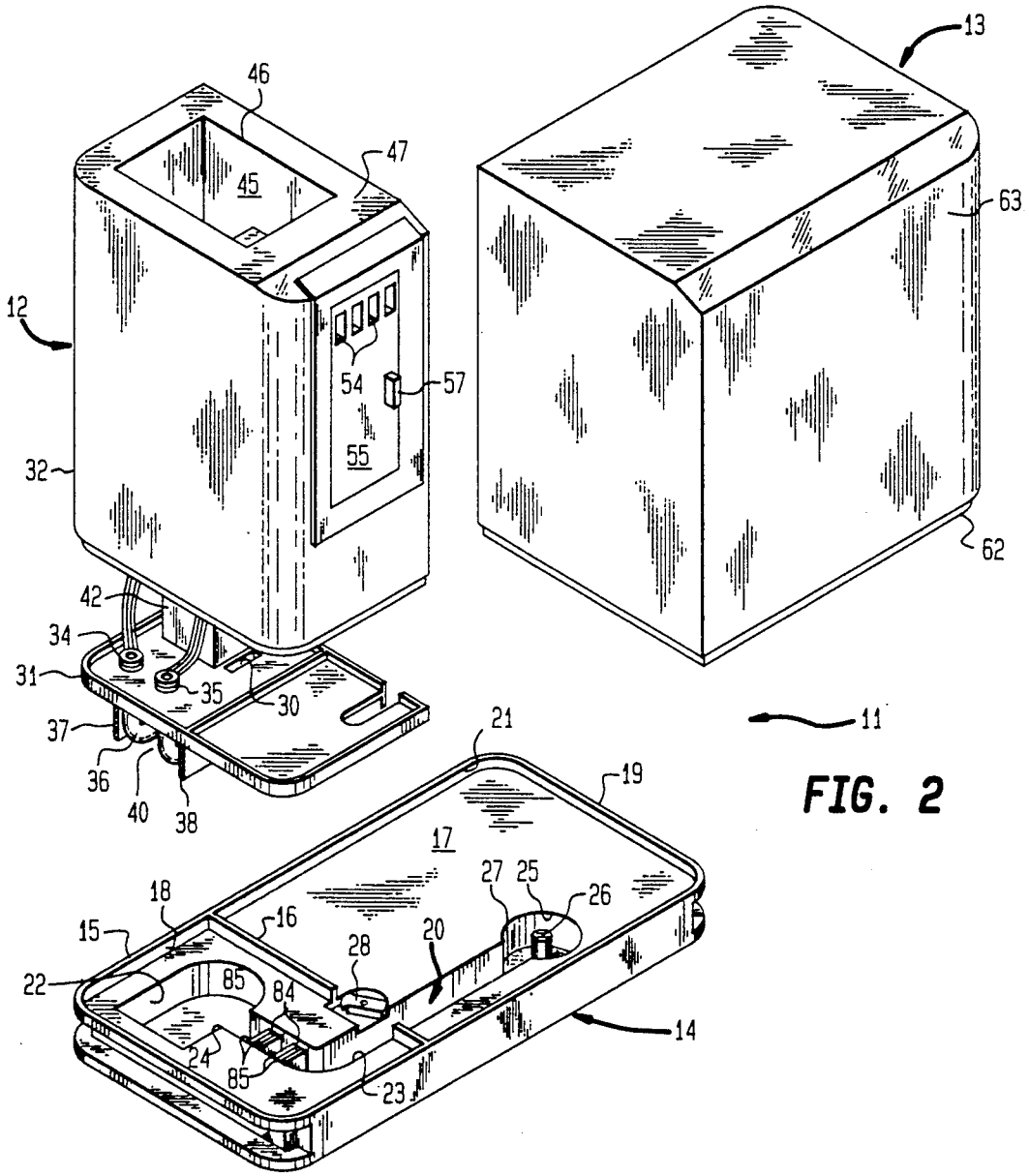
FIG. 2 is an exploded perspective view of the humidifier shown in FIG. 1.
Figure 3:
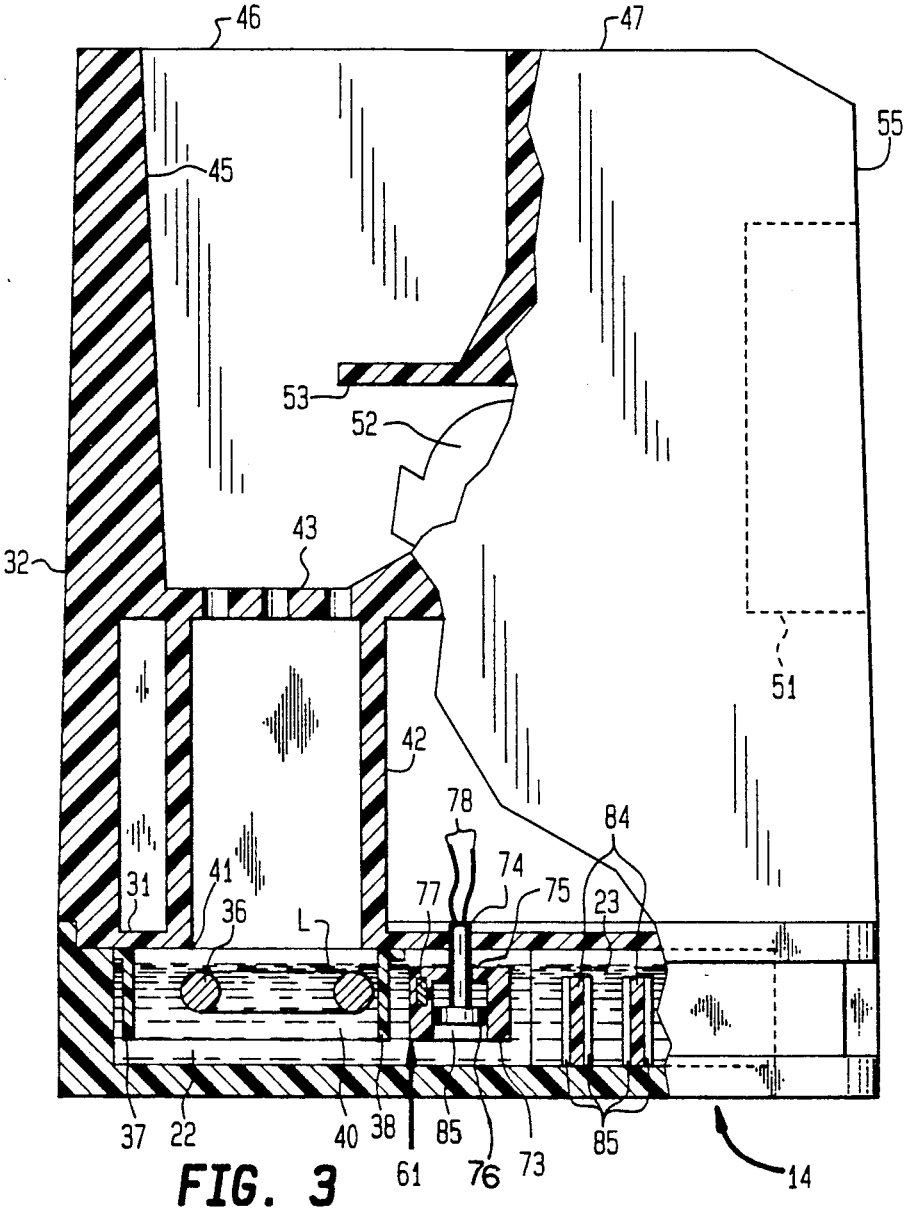
FIG. 3 is a view partially in cross section of the humidifier shown in FIG. 1.

The humidification unit 12, as shown in FIGS. 2 and 3, includes a bottom plate 31 and an enclosure 32 supported thereby. Supported by electrical terminals 34, 35 on the bottom plate 31 and extending downwardly therefrom is an evaporator heater coil 36 that projects into the boiler cavity 22 in the base 14. An enclosure 37 provides a restricted chamber 40 surrounding the heater coil 36 and defines an open bottom end orifice 38 that provides liquid communication into the cavity 22. In addition, the open bottom 38 allows physical access to the heater coil 36 so as to permit cleaning thereof. Extending upwardly from the bottom plate 31 over an opening 41 communicating with the enclosure 37 in the cavity 22 is a rectangular tube 42. A slotted cover 43 closes the upper end of the tube 42. The slotted cover 43 provides fluid communication between the tube 42 and a duct portion 45 defined by the housing 32. Established by the tube 42, the slotted cover 43 and the duct portion 45 is a vapor passage with an inlet communicating via the opening 41 with the restricted chamber 40 and the cavity 22 and an outlet communicating with the surrounding environment via a discharge opening 46 in a top wall 47 of the housing 32. Retained by the housing 32 adjacent to the vapor passage duct portion 45 is electrical control circuitry 51 shown in FIG. 5. Also retained by the housing 32 is an air blower 52 with an outlet disposed to discharge air into the duct portion 45 through an air passage exit opening 53 therein. Air is supplied to the blower 52 through air passage entrance openings 54 in a front wall portion 55 of the housing 32. A control knob 57 for actuating the electrical control circuit 51 is mounted on the front wall portion 55 of the housing 32.

Figure 4:
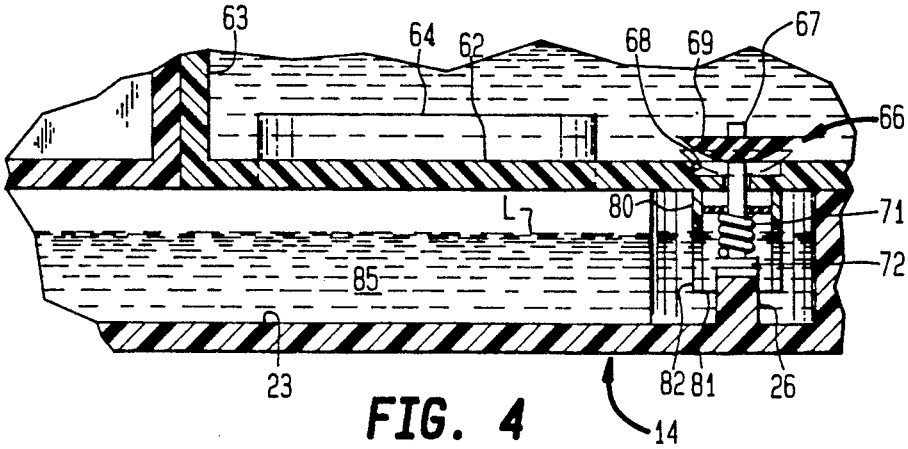
FIG. 4 is a fragmentary cross sectional view illustrating internal components of the humidifier shown in FIG. 1.

A liquid level sensor 61 is supported by the bottom wall 31 of the evaporation unit 12. Included in the sensor 61 is an annular float 73 and a magnetic switch 74 surrounded thereby. As described hereinafter, the switch 74 has active closed and inactive open conditions that, respectively, energize and deenergize the heating coil 36. An inwardly directed collar 75 at the upper end of the float 73 engages an outwardly directed collar 76 at the bottom of the switch 74 to limit downward movement of the float which retains a permanent magnet 77. The condition of the switch is controlled by movement of the actuator float 73 and permanent magnet 77 between activating positions adjacent to the switch 74 as shown in FIG. 4 and inactivating positions spaced therefrom in response to a decrease in the level of the water surface L or removal of the unit 12 from the base 14. Electrical leads 78 connect the switch 74 to the control circuit 51.

The liquid supply tank 13 includes a bottom wall portion 62 retained within the tank enclosure 21 of the base 14 and an upper portion 63 for storing a supply of liquid such as water. Closing an opening in the bottom wall portion 62 of the tank 13 is a threaded cap 64 that can be removed to fill the tank 13. A valve assembly 66 is retained by the bottom wall portion 62 of the tank 13. Forming the valve assembly 66 is a valve stem 67 extending through a discharge opening 68 in the bottom wall portion 62 and a valve 69. A spring 71 extending between the bottom wall portion 62 and a bracket 72 mounted on an end of the stem 67 normally biases the valve 69 into a seated position closing the discharge opening 68 as shown by dashed lines in FIG. 4. Projecting downwardly from the bottom wall portion 62 and enclosing a lower portion of the valve assembly 66 is a skirt 80 having an open bottom end 81 intersected by slots 82.

Disposed in the liquid supply channel 23 are a pair of spaced apart barrier plates 84 that allow liquid flow from the supply tank 13 only into the upper portion of the cavity 22. The plates 84 limit heat loss from the boiler cavity 22 and are removably mounted in spaced apart flanges 85 projecting inwardly from opposite sides of the channel 23. Removal of the barrier plates simplifies cleaning of the supply channel 23.

Figure 5:
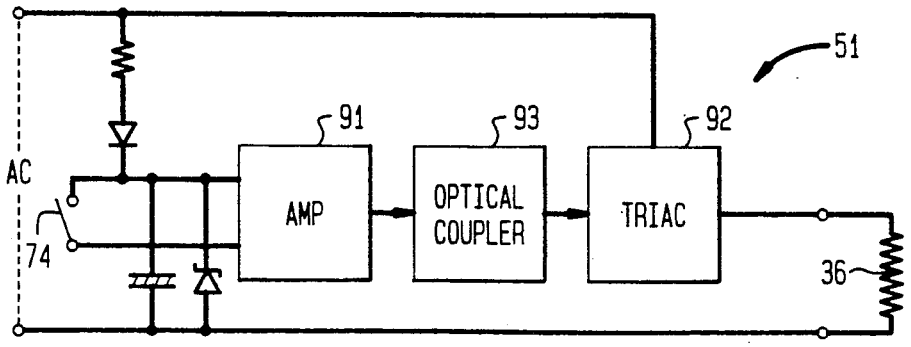
FIG. 5 is a block diagram of a control circuit utilized in the humidifier of FIG. 1.

As shown in FIG. 5, the control circuitry 51 includes an amplifier 91 and a triac 92 operatively coupled together by an optical coupler 93. Electrical energy in the form of electrical current is supplied via a switch (not shown) from an ac supply to the coil heater 36 by the triac 93. Controlling the output of the amplifier 91 is the water level sensing system 61 including the magnetic switch 74.

OPERATION

To prepare the humidifier 11 for use, the tank 13 is removed from the base 14 and filled with water through an opening created by removal of the cap 64. With the cap 64 replaced and the normally seated valve 69 seated over the opening 68, the sealed tank 13 is inverted and positioned on the base 14 within the tank enclosure 21. Engagement of the bracket 72 on the valve stem 67 with the actuator stem 26 on the base 14 moves the valve 69 into an open position as shown by solid lines in FIG. 4. Accordingly, water from the tank 13 flows through the opened valve 69, the inlet end 25 and over the barrier plates 84 in the liquid supply channel 23 into the boiler cavity 22. As long as a supply of water exists in the sealed tank 13, a water level L determined by the height of the slots 82 in the skirt 80 will be retained by the open valve 69 within the reservoir 20 formed by the boiler cavity 22 and the liquid supply channel 23.

Upon energization of the heater coil 36, water within the restricted chamber 40 that has flowed through the open bottom 38 in the enclosure 37 is heated to cause evaporation and resultant upward dispersion thereof. Because of the restricted and isolated water volume provided by the boiler cavity 22 and the enclosure 37, an extremely efficient evaporation process is obtained. The vapor produced in the enclosure 37 rises through the tube 42, the slotted cover 43 and the duct portion 45 of the housing 32 for discharge through the discharge end 46 into the surrounding environment. Enhancement of the vapor dispersion and discharge is obtained by energizing the blower 52 which draws air through the entrance passages 54 in the housing 32 for discharge through the exit passage 53. This air draws vapor formed in the boiler cavity 22 through the duct portion for discharge from the discharge end 46.

Energization of the heater coil 36 is established by activating the AC supply shown in FIG. 5 to apply a voltage to the transistor amplifier 91. Resultant output of the transistor 91 activates the optical coupler 93 producing an output that renders the triac 92 conductive to transmit heating current through the coil 36. However, if the water level in the reservoir 20 and therefore the boiler cavity 22 falls to a predetermined level below the heater coil 36, the float 73 and the retained magnet move downwardly from the activating position shown in FIG. 4 to an inactivating position to open the magnetic switch 74. Accordingly, bias is removed from the transistor amplifier 91 which deenergizes the coupler 93 to turn off the triac 92 and eliminate current flow to the heater coil 36. Similarly, in response to removal of the unit 12 from the base 14, gravity induces downward movement of the actuator float 73 and magnet 77 into an inactivating position relative to the switch 74 so as to induce opening thereof and deenergization of the heater coil 36.

Obviously, many modifications and variations of the present invention are possible in light of the above teachings. It is to be understood, therefore, that the invention can be practiced otherwise than as specifically described.

What is claimed is:

1. A humidifier apparatus comprising:

a base means devoid of electrical components and circuitry and defining a reservoir for receiving liquid;

a humidification unit mounted on said base means and adapted for movement relative thereto so as to provide access to said reservoir; said unit retaining all electrical components and circuitry of said apparatus and comprising electrically energized humidifier means for inducing dispersion of liquid within said reservoir, electrical switch means operatively connected to said humidifier means and adapted in an active state to cause energization thereof and in inactive state to cause deenergization thereof;

a removable tank means for supplying liquid to said reservoir and mounted on said base means adjacent to said unit; and actuator means operatively coupled to said electrical switch means and adapted to provide said inactive state thereof in response to relative separating movement between said unit and said base means.

2. An apparatus according to claim 1 wherein said humidification means is adapted for complete separation from said base means.

3. An apparatus according to claim 2 wherein said base means is an integrally molded unit.

4. An apparatus according to claim 1 wherein said base means is an integrally molded unit.

5. A humidifier comprising:

a base means defining a boiler cavity;

a liquid supply means supported on said base means and having a discharge opening communicating with said boiler cavity and adapted to maintain a given level of liquid therein;

an evaporation unit mounted on said base means and adapted for movement relative thereto so as to provide access to said cavity; said unit comprising an electrically energized heating element projecting into said boiler cavity and adapted to induce evaporation of liquid contained thereby, and a vapor passage defining means having a receiving end communicating with said cavity so as to receive vapor therefrom and a discharge end for discharging the vapor received from said cavity; and electrical control means operatively connected to said heating element and adapted to automatically provide deenergization thereof in response to relative separating movement between said unit and said base means.

6. A humidifier according to claim 5 including electrical supply means for supplying electrical energy to said heating element.

7. A humidifier according to claim 6 wherein said electrical supply means is retained completely in said evaporation unit.

8. A humidifier according to claim 7 wherein said base means is devoid of electrical components and electrical circuitry.

9. A humidifier according to claim 5 wherein said base means is devoid of electrical components and electrical circuitry.

* * * * *